US009506372B2

(12) United States Patent
Schoenhoff et al.

(10) Patent No.: US 9,506,372 B2
(45) Date of Patent: Nov. 29, 2016

(54) DAMPING MEANS FOR DAMPING A BLADE MOVEMENT OF A TURBOMACHINE

(75) Inventors: Carsten Schoenhoff, Munich (DE); Manfred Dopfer, Unterschleissheim (DE); Martin Pernleitner, Dachau (DE); Wilfried Schuette, Oberhaching-Furth (DE)

(73) Assignee: MTU Aero Engines GmbH, Munich (DE)

( * ) Notice: Subject to any disclaimer, the term of this patent is extended or adjusted under 35 U.S.C. 154(b) by 671 days.

(21) Appl. No.: 13/990,338

(22) PCT Filed: Nov. 29, 2011

(86) PCT No.: PCT/DE2011/002110

§ 371 (c)(1),
(2), (4) Date: Jul. 1, 2013

(87) PCT Pub. No.: WO2012/072069

PCT Pub. Date: Jun. 7, 2012

(65) Prior Publication Data

US 2013/0287583 A1 Oct. 31, 2013

(30) Foreign Application Priority Data

Nov. 30, 2010 (DE) ..... 10 2010 052 965

(51) Int. Cl.
*F01D 25/06* (2006.01)
*F01D 5/22* (2006.01)

(52) U.S. Cl.
CPC ..... *F01D 25/06* (2013.01); *F01D 5/22* (2013.01); *F05D 2260/96* (2013.01); *Y10T 29/49316* (2015.01)

(58) Field of Classification Search
CPC ..... F01D 25/06; F01D 5/22
See application file for complete search history.

(56) References Cited

U.S. PATENT DOCUMENTS

| | | | | |
|---|---|---|---|---|
| 3,037,741 | A * | 6/1962 | Tuft | F01D 5/22 416/193 A |
| 3,266,770 | A * | 8/1966 | Harlow | F01D 5/081 416/174 |
| 4,182,598 | A | 1/1980 | Nelson | |
| 5,143,517 | A * | 9/1992 | Vermont | F01D 5/22 416/190 |
| 5,478,207 | A * | 12/1995 | Stec | F01D 5/22 416/219 R |
| 6,851,932 | B2 * | 2/2005 | Lagrange | F01D 5/22 416/190 |
| 7,534,090 | B2 * | 5/2009 | Good | F01D 5/10 415/119 |
| 7,572,098 | B1 * | 8/2009 | Johnson | F01D 9/041 415/119 |
| 2005/0047917 | A1 | 3/2005 | Brock et al. | |
| 2005/0207892 | A1 | 9/2005 | Kanebako et al. | |

FOREIGN PATENT DOCUMENTS

| | | |
|---|---|---|
| DE | 103 40 773 | 3/2005 |
| DE | 10 2005 0008509 | 9/2005 |
| EP | 1 477 634 | 11/2004 |
| EP | 1 512 838 | 3/2005 |
| EP | 1 898 050 | 3/2008 |

* cited by examiner

*Primary Examiner* — Craig Kim
*Assistant Examiner* — Michael Sehn
(74) *Attorney, Agent, or Firm* — Davidson, Davidson & Kappel, LLC

(57) ABSTRACT

A damper (2) for damping a blade movement of a turbomachine (1), and to a method for producing the damper (2). The damper (2) has at least one side surface (21, 21') which can be brought into frictional contact with a friction surface of the turbomachine (1) in order to damp a blade movement. The side surfaces (21, 21') are asymmetrically convex in shape.

16 Claims, 2 Drawing Sheets

DAMPING MEANS FOR DAMPING A BLADE MOVEMENT OF A TURBOMACHINE

The present invention relates to a damper for damping a blade movement of a turbomachine, and to a method for producing the damper.

BACKGROUND

Turbomachines, in particular gas or steam turbines, have a rotor and blades which are coupled to the rotor and distributed around the circumference thereof. The blades must be designed to resist a plurality of stresses during operation of the turbine. Such stresses include, for example, centrifugal forces, erosion-corrosion, and vibrations.

The vibratory stresses to which the present invention relates may result from a combination of the medium passing through the turbine and the forces acting on the blades. In the long term, blade vibrations can cause a change in the microstructure of the blade material, which may eventually lead to a fatigue fracture. Therefore, it is necessary to damp the vibrations of the blades. In the prior art, a plurality of damping means for blade vibrations are known.

In German Patent Document DE 103 40 773, a damping means for a rotor blade of a turbine is disposed in a pocket of a rotor blade platform. The damping means has a triangle-like shape in a cross section normal to the axis and has rounded longitudinal edges. The longitudinal edges each have a symmetrically convex shape between the corners. During operation of the turbine, the damping means contacts an inner wall of the pocket and a friction surface of another rotor blade platform in order to damp movement of the rotor blade.

A disadvantage of the prior art damping means of symmetrically convex shape lies in the manner in which the region of frictional contact with a friction surface of the turbomachine is defined due to the symmetrically convex configuration of the longitudinal edge of the damping means. If the friction surface of the turbomachine has a particular shape, this may result in poor contact of the damping means with the friction surface of the turbomachine. For example, the friction surface of the turbomachine may be configured such that the damping means contacts the friction surface of the turbomachine only in a small region of frictional contact. As a result, the frictional heat produced during damping of the blade movement can only be dissipated through the small region of frictional contact, which may result in damage to or wear of the damping means and/or the corresponding friction part of the turbomachine.

SUMMARY OF THE INVENTION

It is an object of the present invention to improve the damping of a turbomachine blade.

The present invention provides a damper that has at least one asymmetrically convex side surface intended to damp a blade movement of a turbomachine. When the blade vibrates during operation of the turbomachine, the vibrational movement of the blade is damped by friction of the side surface of the damper with the friction surface of the turbomachine in the region of frictional contact.

In the process, the asymmetrically convex side surface allows the region of frictional contact between the friction surface of the turbomachine and the side surface of the damper to be shifted to a more convenient region. Preferably, the region of frictional contact is shifted such that the region of frictional contact between the side surface of the damper and the friction surface of the turbomachine is enlarged. The frictional heat produced during damping of the blade movement can be dissipated into a friction part of the turbomachine through the enlarged region of frictional contact. This reduces the risk of the damper and/or the friction part being damaged or worn during damping of the blade movement.

Another advantage of using an asymmetrically convex side surface is that when the side surface of the damper becomes worn by friction and/or heating, the friction region of the damper, and thus the region of frictional contact between the damper and the friction surface of the turbomachine, is enlarged more than proportionally. A larger region of frictional contact allows frictional heat to be dissipated more rapidly, thereby reducing the risk of damage to and/or wear of the damper and/or the friction part of the turbomachine. Yet another advantage of an asymmetrically convex side surface is that friction-induced wear results in an adaptation of the friction region of the damper to the respective friction surface of the friction part of the turbomachine. In this manner, manufacturing accuracies of the friction part are compensated for. Ultimately, this reduces the manufacturing effort required to produce the friction part of the turbomachine.

The term "convex" is understood in the context of the present invention to mean a convexly curved surface. The term "asymmetrical surface" is understood in the context of the present invention to be a surface having two separated regions that cannot be transformed into each other by reflection in an axis or plane. Therefore, an "asymmetrically convex side surface" is understood in the context of the present invention to be a convexly curved side surface that has two differently shaped zones. The zones are so shaped that there is no plane of symmetry normal to the side surface, with respect to which the zones separated by the plane of symmetry would be mirror-symmetric.

The term "region of frictional contact" is understood in the context of the present invention to be a region in which friction occurs between the friction region of the damper and the friction surface of the turbomachine during blade movement.

A "friction part" is understood in the context of the present invention to be any part of a turbomachine that is in frictional contact with the damping means to damp blade vibration. A friction part may, in particular, form part of a blade, or may be coupled to a blade. In the context of the present invention, a friction part may be, for example, a blade platform, a shroud segment of a blade, and a positioner for positioning the rotor blade in the axial direction of the rotor. The aforementioned friction parts will be described in more detail below.

In a preferred embodiment, the asymmetrically convex side surface may be capable of slightly rotating about a damper axis. The friction of the side surface with the friction surface of the turbomachine causes a frictional force to act on the damper. This frictional force may cause a slight rotation of the damper. The asymmetrically convex side surface is configured such that the friction region of the damper, and thus the region of frictional contact between the damper and the friction part of the turbomachine, is enlarged upon slight rotation of the damper.

The side surface may have at least two zones of different radii of curvature. At least one zone which is radially farther away from the rotor axis may have a smaller radius of curvature than a zone that is radially closer to the rotor axis. The damping of blade vibration is improved when the friction surface of the turbomachine contacts the zone of the side surface that has the aforementioned small radius of curvature. The improvement in damping results because the zone of frictional contact forms in a region of the side surface of the damper that is distal from the rotor axis. In this connection, it holds that the farther away the zone of frictional contact is from the rotor axis, the greater is the frictional torque which is caused by the frictional force occurring in the zone of frictional contact and which damps the vibration of the blade.

In an advantageous embodiment of the present invention, the damper has a main body that has a triangular or polygonal shape in a cross section normal to the axis. The side surfaces of the triangular or polygonal main body may each have rounded corners of the main body. The zone of the asymmetrically convex side surface that has a smaller radius of curvature and that is disposed at the end of the side surface which is distal from the rotor axis may be located in each instance adjacent to a respective one of the rounded corners.

The damper may have attached thereto an anti-rotation means and/or a fastening means. The anti-rotation means prevents or limits rotation of the damper about a damper axis within a pocket of the turbomachine. During operation of the turbomachine, the damper is moved in a direction away from the rotor axis due to centrifugal force. The damper is acted upon by a rotational force which causes the damper to rotate about the damper axis until the anti-rotation means abuts against an abutment surface provided on the turbomachine. The anti-rotation means is preferably designed such that it abuts against the abutment surface when the damper is rotated into a position where the above-mentioned zone having the small radius of curvature is in frictional contact with the friction surface of the turbomachine.

When the side surface becomes worn by the friction, the shape of the damper, and thus the position of its center of gravity, change. The position of the center of gravity can be adjusted by suitably designing the side surfaces of the damper. This makes it possible to improve the dynamic properties of the damper.

The fastening means serves to prevent or limit movement of the damper, in particular in the direction of the rotor axis of the turbomachine. Thus, the fastening means ensures that the damper cannot leave the pocket of the turbomachine.

The turbomachine may be a gas or steam turbine, and, in particular, an aircraft engine. The turbomachine has a rotor and stator and rotor blades which are distributed around the circumference of the rotor and arranged in succession in the direction of gas flow. The rotor is provided with grooves which are distributed around its circumference and extend parallel to the rotor axis. The blade, in particular a rotor blade, may have a shroud segment, an airfoil, a blade platform, and a blade root. The blade is positioned by the blade foot in the groove in radially fixed relationship to the rotor axis. Fixing of the blade in the axial direction of the rotor may be accomplished by a securing plate provided in the groove and/or by a positioning means separately provided on the rotor.

Blade vibration can occur in a blade relative to the rotor and/or between two or several blades. For purposes of damping blade vibration, the damper may be disposed at different locations in the turbomachine.

The shroud segment of a blade may have a pocket which at least partially defines an, in particular closed, cavity and in which the damper is disposed. For example, the cavity may be defined by the pockets of two shroud segments of adjacent blades. The damper is disposed in the pocket such that when the turbomachine is operating, one side surface of the damper is in frictional contact with a friction surface of the pocket of one shroud segment, and another side surface of the damper is in frictional contact with a friction surface of the other shroud segment.

Alternatively or additionally, a damper may be disposed in a pocket of a positioning means which secures the position of the blade in the axial direction of the rotor. In this case, the damper is disposed such that one side surface thereof is in frictional contact with a friction surface of the positioning means. Another side surface of the damper is in contact, in particular frictional contact, with a blade surface.

Alternatively or additionally, a damper may be disposed in a pocket of a blade platform. The blade platform is located between the blade root and the airfoil. The damper is disposed in the pocket such that when the turbomachine is operating, one side surface of the damper is in frictional contact with a friction surface of the blade platform in which the pocket is formed, and another side surface of the damper is in frictional contact with a friction surface of an adjacent blade platform.

The damper, which has least one asymmetrically convex side surface, may preferably be manufactured by primary shaping, forming and/or machining techniques.

BRIEF DESCRIPTION OF THE DRAWINGS

Further features and advantages will become apparent from the dependent claims and the exemplary embodiment. In the drawings.

DETAILED DESCRIPTION

Figure 1:
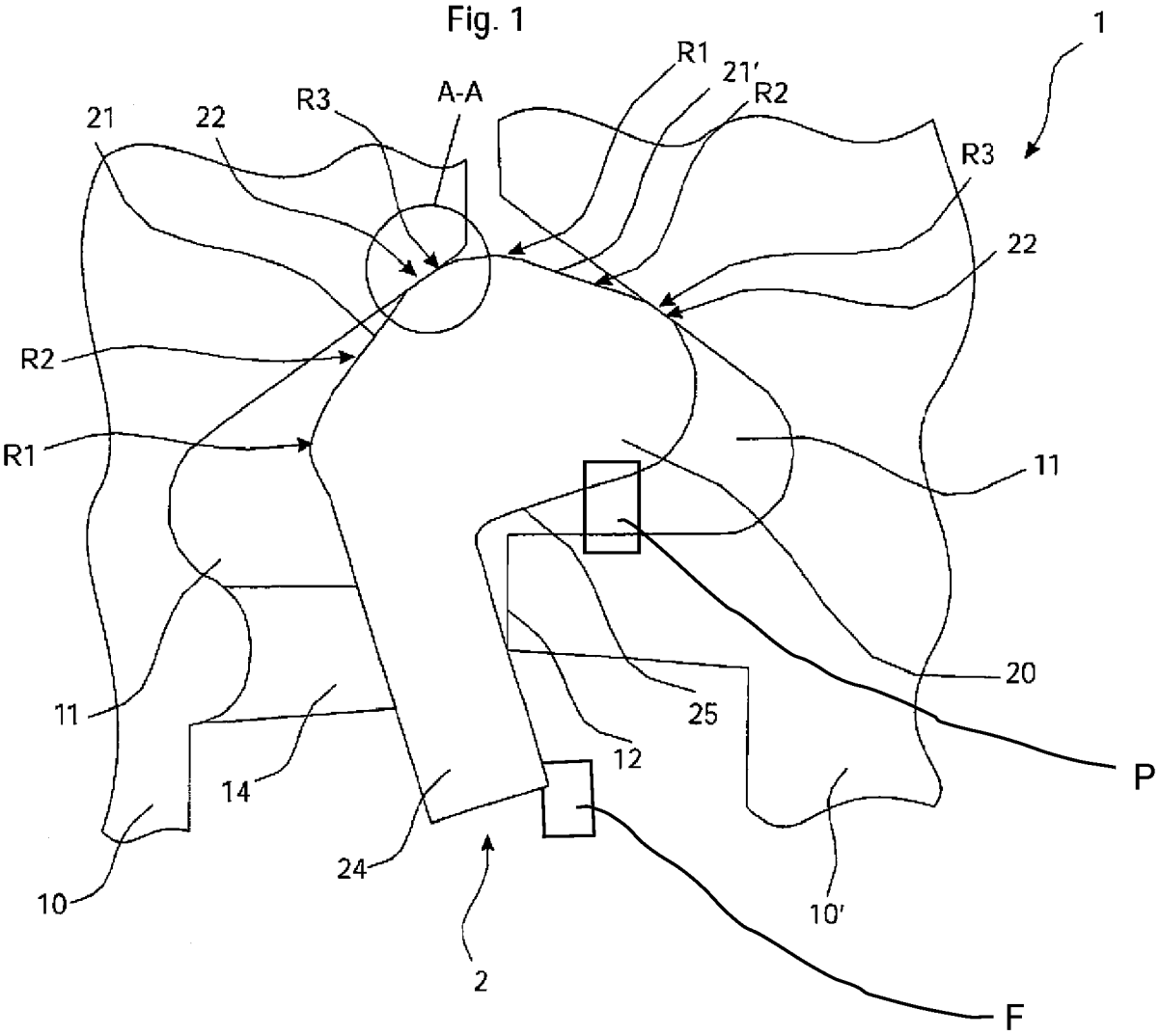
FIG. 1 is a schematic view of a damper in a cavity according to an embodiment of the present invention.

Damper 2 shown in FIG. 1 has a main body 20 having a substantially triangular shape in a cross section normal to the axis. Triangular main body 20 has a supporting surface 25 and two side surfaces 21, 21', which merge into one another via rounded ends. Side surfaces 21, 21' each have an asymmetrically convex shape. The asymmetrically convex shape of the individual side surfaces 21, 21' results because side surfaces 21, 21' each have three zones having different radii of curvature R1, R2, R3. Damper 2 further has an anti-rotation means 24 which is attached to main body 20 and extends via supporting surface 25 in a radial direction with respect to the rotor axis.

Damper 2 is disposed in a cavity defined by two pockets 11 of adjacent blades 10, 10' of a turbomachine 1. The cavity has a triangular profile in a cross section normal to the axis. The individual cavity walls are longer than the respective side surfaces 21 and supporting surface 25 of damper 2. Damper 2 is disposed in the cavity such that it is contact with the cavity walls of both blades 10, 10', regardless of the operating condition of turbomachine 1.

Both side surfaces 21, 21' of damper 2 have a first zone having a first radius of curvature R1, a second zone having a second radius of curvature R2, and a third zone having a third radius of curvature R3. Moreover, in both side surfaces 21, 21', the second zone having the second radius of curvature R2 is disposed between the first zone and the third zone and is longer than the first zone and the third zone. Third radius of curvature R3 has a smaller value than first radius of curvature R1 and second radius of curvature R2. Moreover, first radius of curvature R1 has a smaller value than second radius of curvature R2.

In first side surface 21, the first zone having the first radius of curvature R1 is disposed at the end of side surface 21 that is radially proximal to the rotor axis. The third zone having the third radius of curvature R3 is disposed at the end of side surface 21 that is radially distal from the rotor axis, and is in frictional contact with the respective cavity wall in a region of frictional contact 22.

In second side surface 21', the first zone having the first radius of curvature R1 is disposed at the end of side surface 21' that is radially distal from the rotor axis. The third zone having the third radius of curvature R3 is disposed at the end of side surface 21' that is radially proximal to the rotor axis, and is in frictional contact with the respective cavity wall in a region of frictional contact 22.

Blade 10 of turbomachine 1 is configured to have a recess 14 through which anti-rotation means 24 extends radially with respect to the rotor axis. Recess 14 is bounded by the walls of recess 14 and an abutment surface 12. Abutment surface 12 is provided on the blade 10' that is adjacent to the blade 10 having recess 14. Recess 14 is configured such that damper 2 cannot fall out from the cavity therethrough when the turbine is at rest. When turbomachine 1 is in a condition of rest (not shown), supporting surface 25 of damper 2 rests against the respective cavity wall, and anti-rotation means 24 extends through recess 14 in a radial direction with respect to the rotor axis.

During operation of turbomachine 1, damper 2 is moved radially away from the rotor axis due to centrifugal force until side surfaces 21, 21' abut against the cavity walls. During this movement toward the cavity walls, damper 2 is rotated about a damping axis.

Damper 2 is rotated until anti-rotation means 24 abuts against abutment surface 12 of the one blade 10'. Ultimately, the two side surfaces 21, 21' of damper 2 are in frictional contact with the cavity walls in a respective region of frictional contact 22. When one or both of blades 10, 10' move radially and/or axially, the blade movement can be damped by the frictional contact of damper 2 with the cavity walls.

The positioning means P and fastening means F described above are shown schematically.

Figure 2:
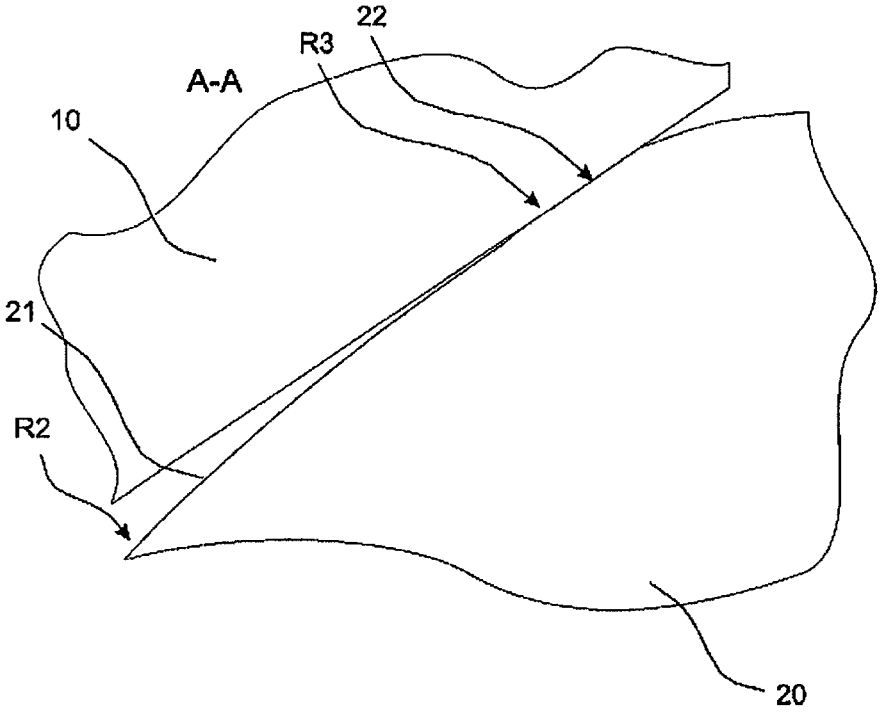
FIG. 2 is an enlarged view A-A from FIG. 1 of a region of frictional contact according to an embodiment of the present invention.

FIG. 2 is an enlarged view A-A from FIG. 1 of a region of frictional contact 22. As can be seen in FIG. 2, the third zone having the third radius of curvature R3 of first side surface 21 is in frictional contact with the cavity wall. The second zone of first side surface 21, which has a radius of curvature R2 greater than radius of curvature R3, is not in frictional contact with the cavity wall.

What is claimed is:

1. A damper for damping a blade movement of a turbomachine, the damper comprising:

a single piece body having a polygonal shape in a cross section normal to a rotor axis of the turbomachine, wherein the single piece body includes a first side surface intended to damp the blade movement by frictional contact with a friction surface of a first blade of the turbomachine, the first side surface being asymmetrically convex in shape, the asymmetrically convex first side surface having a convexly curved first frictional contact region;

a second side surface intended to damp the blade movement by frictional contact with a friction surface of a second blade of the turbomachine, the second side surface being asymmetrically convex in shape, the asymmetrically convex second side surface having a convexly curved second frictional contact region;

wherein each of the first and second side surfaces include a first zone, a second zone and a third zone each having different radii of curvature, the first, second and third zones of the first side surface facing the first blade, the first, second and third zones of the second side surface facing the second blade;

wherein the convexly curved first and second frictional contact regions are in the respective third zones of the first and second side surfaces;

wherein the first and second zones of the first and second side surfaces are not in contact with the first and second blades, respectively;

where the third zone has a radius of curvature smaller than the first and second zones, and the first zone has a radius of curvature smaller than the second zone.

2. The damper as recited in claim 1 wherein the third zones are radially farther away from a rotor axis of the turbomachine than the first and second zones.

3. The damper as recited in claim 1 further comprising an anti-rotator.

4. The damper as recited in claim 1 further comprising a fastener for limiting movement of the damper.

5. The damper as recited in claim 4 wherein the fastener limits movement in a direction of a rotor axis of the turbomachine.

6. A turbomachine comprising:

a rotor;

at least the first and second blades; and the damper as recited in claim 1.

7. The turbomachine as recited in claim 6 wherein the first and second blades are first and second rotor blades coupled to the rotor.

8. The turbomachine as recited in claim 6 wherein each of the first and second blades include an airfoil and a shroud segment at the end of the airfoil distal from the rotor, the shroud segment having a pocket at least partially defining a cavity, the damper being disposed in the cavity.

9. The turbomachine as recited in claim 8 wherein the cavity is a closed cavity.

10. The turbomachine as recited in claim 6 wherein the damper is at least partially disposed in a positioner for positioning the blade in the axial direction.

11. The turbomachine as recited in claim 6 wherein the first and second blades each include an airfoil and a platform at the end of the airfoil proximal to the rotor, the platforms each having a pocket, the pockets together at least partially defining a cavity, the damper being disposed in the cavity.

12. The turbomachine as recited in claim 11 wherein the cavity is a closed cavity.

13. A gas or steam turbine comprising the turbomachine as recited in claim 6.

14. The turbomachine as recited in claim 6 wherein the convexly curved frictional contact region contacts a flat surface of a cavity wall of the blade.

15. The turbomachine as recited in claim 6 wherein when the convexly curved first and second frictional contact regions are in contact with a cavity wall of the first and second blades, the damper is capable of rotating about a damper axis.

16. A method for operating the damper as recited in claim 1 comprising:

dissipating frictional heat produced during the damping of the blade movement into the friction part through the enlarged region of frictional contact, in order to reduce a risk of damage or wear to the damper or friction part by frictional heat during the damping of the blade movement.

* * * * *